US009008919B2

(12) United States Patent
Lee et al.

(10) Patent No.: US 9,008,919 B2
(45) Date of Patent: Apr. 14, 2015

(54) SWING CONTROL APPARATUS AND METHOD OF CONSTRUCTION MACHINERY

(75) Inventors: Chun-Han Lee, Gimhae-si (KR); Jin-Seop Kim, Changwon-si (KR)

(73) Assignee: Volvo Construction Equipment AB (JP)

( * ) Notice: Subject to any disclaimer, the term of this patent is extended or adjusted under 35 U.S.C. 154(b) by 31 days.

(21) Appl. No.: 13/809,820

(22) PCT Filed: Jul. 13, 2010

(86) PCT No.: PCT/KR2010/004528

§ 371 (c)(1), (2), (4) Date: Jan. 11, 2013

(87) PCT Pub. No.: WO2012/008627

PCT Pub. Date: Jan. 19, 2012

(65) Prior Publication Data

US 2013/0116897 A1 May 9, 2013

(51) Int. Cl.

| | |
|---|---|
| ***E02F 9/00*** | (2006.01) |
| ***E02F 9/12*** | (2006.01) |
| ***E02F 9/20*** | (2006.01) |
| *A01B 63/00* | (2006.01) |

(Continued)

(52) U.S. Cl.

CPC ..... *E02F 9/2033* (2013.01); *E02F 9/128* (2013.01)

(58) Field of Classification Search

CPC ..... A01B 69/008; A01B 79/005; E02F 9/128; E02F 9/20; E02F 9/2025; E02F 9/2029; E02F 9/2033; E02F 9/2041; E02F 9/2045; E02F 9/26; E02F 9/262

USPC ..... 701/50; 172/2, 3, 412, 422; 175/4.51, 175/24, 45

See application file for complete search history.

(56) References Cited

U.S. PATENT DOCUMENTS 5,259,468 A * 11/1993 Warren et al. ..... 175/45
6,862,509 B2 * 3/2005 Rau et al. ..... 701/50

(Continued)

FOREIGN PATENT DOCUMENTS

EP 734993 A2 * 10/1996
EP 1813728 A1 * 8/2007

(Continued)

OTHER PUBLICATIONS

International Search Report (in Korean and English) and Written Opinion (in Korean) for PCT/KR2010/004528, mailed Apr. 26, 2011; ISA/KR.

(Continued)

*Primary Examiner* — Mary Cheung
*Assistant Examiner* — Atul Trivedi
(74) *Attorney, Agent, or Firm* — Harness, Dickey & Pierce, P.L.C.

(57) ABSTRACT

A swing control apparatus and a swing control method for a construction machine are provided. The swing control apparatus includes a start position estimation unit, a stop target position calculation unit, and a swing motor position control unit. Even if an operator releases a lever or commands a stop at different times, an upper swing structure of the construction machine (for example, excavator) can be stopped within a predetermined range, and thus the inconvenience caused by an additional driving operation, which is required as the stop position differs according to the time point where the stop command starts, can be solved.

2 Claims, 4 Drawing Sheets

(51) Int. Cl.
*A01B 63/11* (2006.01)
*A01B 63/111* (2006.01)

(56) References Cited

U.S. PATENT DOCUMENTS

| | | | | |
|---|---|---|---|---|
| 7,574,821 | B2 * | 8/2009 | Furem | 37/348 |
| 7,753,132 | B2 * | 7/2010 | Stanek et al. | 172/2 |
| 8,190,334 | B2 * | 5/2012 | Kagoshima et al. | 701/50 |
| 8,204,653 | B2 * | 6/2012 | Sahlin et al. | 701/50 |
| 8,437,923 | B2 * | 5/2013 | Sano et al. | 701/50 |
| 8,818,649 | B2 * | 8/2014 | Udagawa | 701/50 |
| 2005/0166413 | A1 * | 8/2005 | Crampton | 33/503 |
| 2005/0177292 | A1 * | 8/2005 | Okamura et al. | 701/50 |
| 2008/0164832 | A1 * | 7/2008 | Kawaguchi et al. | 318/456 |
| 2008/0235970 | A1 * | 10/2008 | Crampton | 33/503 |
| 2010/0264106 | A1 * | 10/2010 | Kawai et al. | 212/276 |
| 2011/0029206 | A1 * | 2/2011 | Kang et al. | 701/50 |
| 2011/0106384 | A1 * | 5/2011 | Corke et al. | 701/50 |
| 2012/0082536 | A1 * | 4/2012 | Kawashima et al. | 414/694 |
| 2013/0051963 | A1 * | 2/2013 | Taylor | 414/685 |
| 2013/0075156 | A1 * | 3/2013 | Casadei | 175/27 |
| 2013/0234642 | A1 * | 9/2013 | Igarashi et al. | 318/611 |
| 2014/0336882 | A1 * | 11/2014 | Claxton | 701/50 |

FOREIGN PATENT DOCUMENTS

| | | | |
|---|---|---|---|
| EP | 1914353 | A2 * | 4/2008 |
| EP | 2071085 | A2 * | 6/2009 |
| JP | 62-033946 | B2 | 2/1987 |
| JP | 62-215733 | A | 9/1987 |
| JP | 03-253914 | A | 11/1991 |
| JP | 04-041395 | B2 | 2/1992 |
| KR | 10-1996-0013595 | B1 | 10/1996 |
| KR | 10-2008-0099749 | A | 11/2008 |

OTHER PUBLICATIONS

International Preliminary Report on Patentability (Chapter II of the Patent Cooperation Treaty) in Korean for PCT/KR2010/004528; dated Nov. 21, 2012; IPEA/KR.
Office Action dated Sep. 30, 2014 in corresponding JP2013-519559.

* cited by examiner

SWING CONTROL APPARATUS AND METHOD OF CONSTRUCTION MACHINERY

TECHNICAL FIELD

The present invention relates to a swing control apparatus and a swing control method for a construction machine. More particularly, the present invention relates to a swing control apparatus and a swing control method for a construction machine, which can stop an upper swing structure of the construction machine (for example, excavator) within a range that is determined by a predetermined equation even if an operator releases a lever or gives a stop command at different time points, and thus can solve the inconvenience caused by an additional swing operation that is required as the stop position differs depending on the time point where the stop command starts.

BACKGROUND ART

In general, a construction machine (particularly, an excavator) performs digging and dumping works within a predetermined range in left and right directions. In this case, if it is intended to stop an upper swing structure, the upper swing structure is stopped at a certain point after performing a swing operation at a predetermined angle from a corresponding stop starting time point (see FIG. 2).

Further, even in a swing stop operation according to a swing control in the related art, as illustrated in FIGS. 3 and 4, the upper swing structure starts deceleration at a time point where an operator releases a lever or gives a stop command, and is stopped at a certain time point after it swings at a predetermined angle. Accordingly, the stop position of the upper swing structure differs depending on the time point where the stop command starts, and thus an additional driving operation is required for the upper swing structure to reach a desired stop position.

DISCLOSURE

Technical Problem

Therefore, the present invention has been made to solve the above-mentioned problems occurring in the related art, and the subject to be solved by the present invention is to provide a swing control apparatus and a swing control method for a construction machine (particularly, an excavator), which can stop an upper swing structure of the construction machine (for example, excavator) within a predetermined range even if an operator releases a lever or gives a stop command at different time points.

Technical Solution

In accordance with one aspect of the present invention, there is provided a swing control apparatus for a construction machine, including: a start position estimation unit calculating or estimating an optimum stop starting position for stopping an upper swing structure in a stop position (or at a stop angle) set by a user using the set stop position (or the set stop angle); a stop target position calculation unit calculating a stop target position using a current position of the upper swing structure and the calculated or estimated optimum stop starting position when a user's stop command is input; and a swing motor position control unit controlling a position of a swing motor so that the upper swing structure is stopped in the calculated stop target position.

Preferably, the start position estimation unit may be any one of a means for calculating the optimum stop starting position based on a mass moment of inertia and a maximum torque of the upper swing structure of the construction machine and a means for calculating the optimum stop starting position through interpolation using a lookup table that defines a mapping relation between the stop position set by the user and the stop starting position.

Further, the stop target position calculation unit may be a means for calculating the stop target position that is determined as follows:

1) in the case where the current position is between A1 and A2, stop target position=(A2−current position)/(A2−A1)*(E2−E1)+E1, where, A2 denotes the optimum stop starting position, A1 denotes the minimum value that is set by the user based on A2 or in consideration of a preset stop command range, E2 denotes the stop position (or angle) set by the user, and E1 denotes the minimum position that is set by the user based on E2 or in consideration of a preset stop position range, and 2) in the case where the current position is between A2 and A3, stop target position=(A3−current position)/(A3−A2)*(E3−E2)+E2, where, A3 denotes the maximum value that is set by the user based on A2 or in consideration of a preset stop command range, E3 denotes the maximum position that is set by the user based on E2 or in consideration of a preset stop position range, A2 denotes the optimum stop starting position, and E2 denotes the stop position (or angle) set by the user.

In accordance with another aspect of the present invention, there is provided a swing control method for a construction machine including: calculating or estimating an optimum stop starting position for stopping an upper swing structure in a stop position (or at a stop angle) set by a user using the set stop position (or the set stop angle); calculating a stop target position using a current position of the upper swing structure and the calculated or estimated optimum stop starting position when a user's stop command is input; and controlling the position of a swing motor so that the upper swing structure is stopped in the calculated stop target position.

Preferably, the step of calculating or estimating the stop starting position may calculate the optimum stop starting position based on a mass moment of inertia and a maximum torque of the upper swing structure of the construction machine, or calculate the optimum stop starting position through interpolation through a lookup table that defines a mapping relation between the stop position set by the user and the stop starting position.

Further, the step of calculating the stop target position calculates the stop target position that is determined as follows:

1) in the case where the current position is between A1 and A2, stop target position=(A2−current position)/(A2−A1)*(E2−E1)+E1, where, A2 denotes the optimum stop starting position, A1 denotes the minimum value that is set by the user based on A2 or in consideration of a preset stop command range, E2 denotes the stop position (or angle) set by the user, and E1 denotes the minimum position that is set by the user based on E2 or in consideration of a preset stop position range, and 2) in the case where the current position is between A2 and A3, stop target position=(A3−current position)/(A3−A2)*(E3−E2)+E2, where, A3 denotes the maximum value that is set by the user based on A2 or in consideration of a preset stop command range, E3 denotes the maximum position that is set by the user based on E2 or in consideration of a preset stop position range, A2 denotes the optimum stop starting position, and E2 denotes the stop position (or angle) set by the user.

Advantageous Effect

According to the swing control apparatus and the swing control method for a construction machine according to the present invention, the optimum stop starting position for stopping the upper swing structure in the stop position (or at the stop angle) set by the user using the set stop position (or the set stop angle) is calculated or estimated, the stop target position is calculated using the current position of the upper swing structure and the calculated or estimated optimum stop starting position when the user's stop command is input, and the position of a swing motor is controlled so that the upper swing structure is stopped in the calculated stop target position. Accordingly, the upper swing structure of the construction machine can be stopped within the range that is determined by the predetermined equation even if the operator releases the lever or gives the stop command at different time points, and thus the inconvenience can be solved which is caused by the additional driving operation that is required as the stop position differs depending on the time point where the stop command starts.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

301: start position estimation unit
302: stop target position calculation unit
303: swing motor position control unit
304: swing motor

BEST MODE

Figure 1:
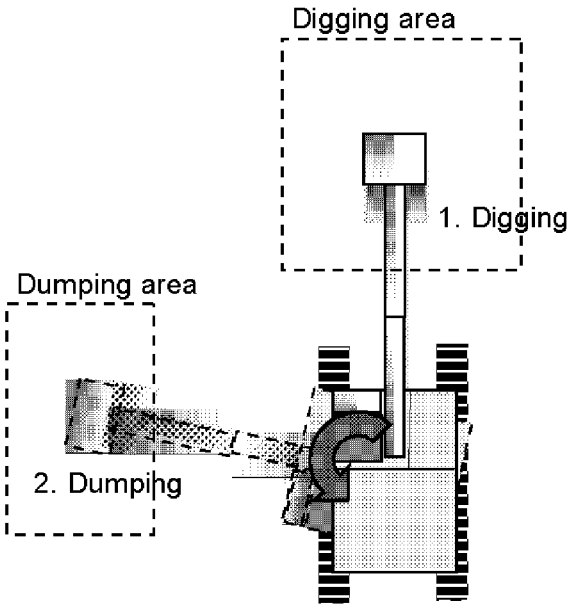
FIGS. 1 and 2 are exemplary diagrams illustrating a general excavating work.
Figure 2:
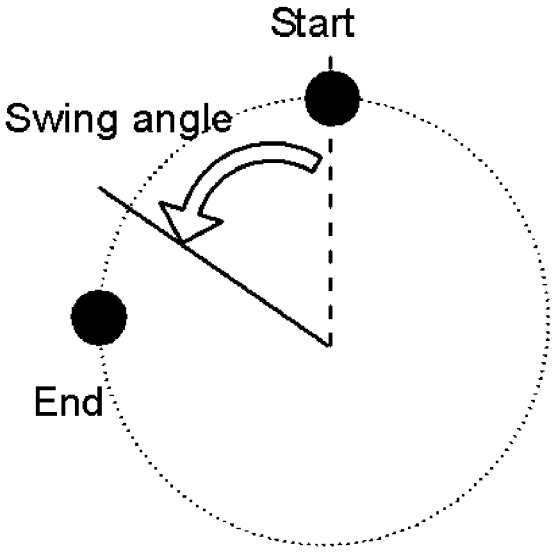
Figure 3:
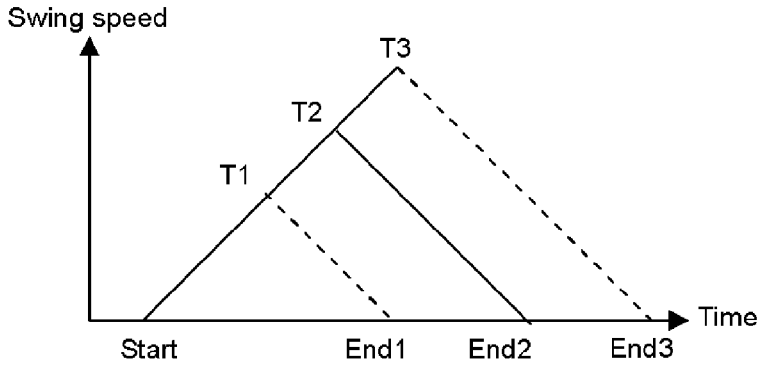
FIGS. 3 and 4 are diagrams schematically illustrating swing control operations in the related art.
Figure 4:
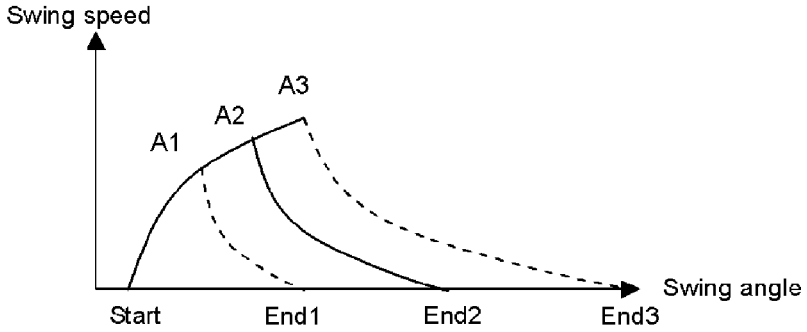
Figure 5:
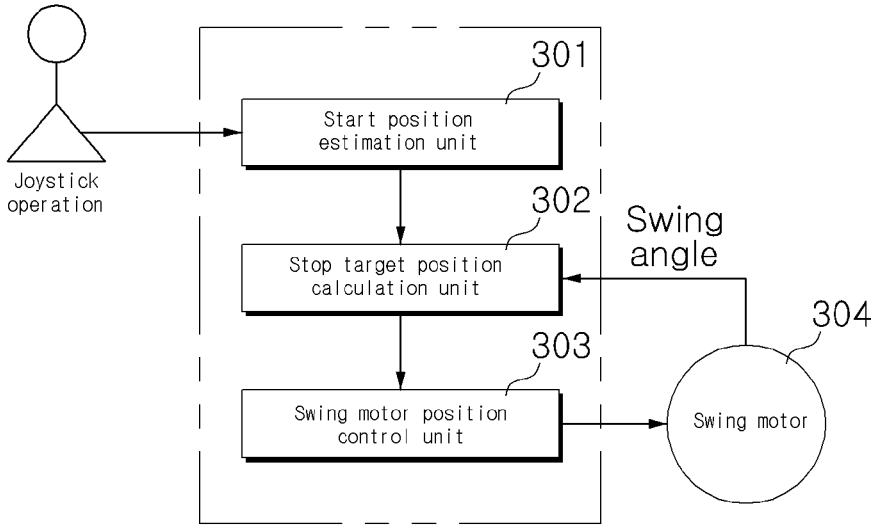
FIG. 5 is a block diagram illustrating the configuration of a swing control apparatus for a construction machine according to an embodiment of the present invention.

FIG. 5 is a block diagram illustrating the configuration of a swing control apparatus for a construction machine according to an embodiment of the present invention.

As illustrated in FIG. 5, the swing control apparatus for a construction machine includes a start position estimation unit 301 calculating or estimating an optimum stop starting position for stopping an upper swing structure in a stop position (or at a stop angle) set by a user using the set stop position (or the set stop angle); a stop target position calculation unit 302 calculating a stop target position using a current position of the upper swing structure and the calculated or estimated optimum stop starting position when a user's stop command is input; and a swing motor position control unit 303 controlling a position of a swing motor so that the upper swing structure is stopped in the calculated stop target position.

Here, the start position estimation unit 301 calculates or estimates the optimum stop starting position for stopping the upper swing structure in the stop position (or angle) set by the user in the case where the user sets the stop position (or angle) of the upper swing structure.

The detailed calculation or estimation method is as follows.

(1) Example 1 where the user calculates or estimates the optimum stop starting position A2 using the stop position E2 set by the user In the case where the user optionally inputs E2 with figures (for example, 90 degrees), the optimum stop starting position is typically calculated on the basis of a mass moment of inertia and a maximum torque of the upper swing structure of a general excavator or through preparation of a lookup table by experiments and interpolation using the lookup table.

For example, if a lookup table such as Table 1 is prepared, and E2 is set to 100 degrees, A2 becomes (135−100)/(135−80)*(80−45)+45=67.2 degrees.

TABLE 1

| | E2 | | | |
|---|---|---|---|---|
| | 45 | 90 | 135 | 180 |
| A2 | 25 | 45 | 80 | 135 |

(2) Example 2 where the user calculates or estimates the optimum stop starting position A2 using the stop position E2 set by the user.

Figure 6:
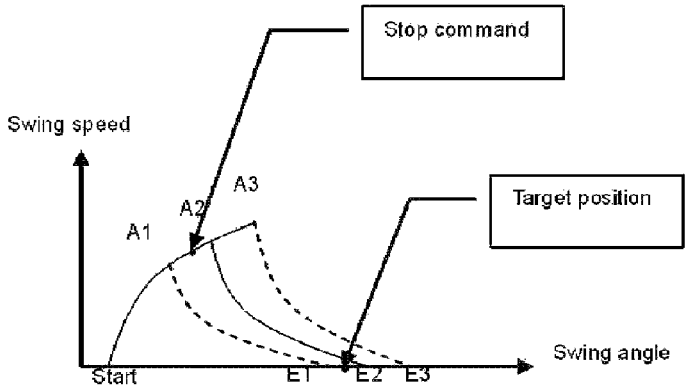
FIG. 6 is a diagram schematically illustrating an aspect of calculating a stop starting position and a stop target position according to an embodiment of the present invention.

As illustrate in FIG. 6, if the user sets E2 by directly taking the excavator for a test drive, the point where the stop command is actually input may be stored and used as A2.

If the stop command for the upper swing structure is input according to a user's key operation, the stop target position calculation unit 302 calculates the stop target position using the current position of the upper swing structure and the calculated or estimated optimum stop starting position (see FIG. 6).

For example, the stop target position may be calculated as follows.

(1) As illustrated in FIG. 6, if the current position is between A1 and A2, the stop target position is calculated through linear interpolation as below.

$$\text{stop target position}=(A2-\text{current position})/(A2-A1)*(E2-E1)+E1$$

Here, A2 denotes the optimum stop starting position, A1 denotes the minimum value that is set by the user based on A2 or in consideration of a preset stop command range, E2 denotes the stop position (or angle) set by the user, and E1 denotes the minimum position that is set by the user based on E2 or in consideration of a preset stop position range.

(2) Next, as illustrated in FIG. 6, if the current position is between A2 and A3, the stop target position is calculated through linear interpolation as below.

$$\text{stop target position}=(A3-\text{current position})/(A3-A2)*(E3-E2)+E2$$

Here, A3 denotes the maximum value that is set by the user based on A2 or in consideration of a preset stop command range, E3 denotes the maximum position that is set by the user based on E2 or in consideration of a preset stop position range, and A2 and E2 denote the same as described above.

If the stop command is input in a state where the current position corresponds to 40 degrees and it is set that A2=45 degrees, A1=35 degrees, E2=90 degrees, and E1=88 degrees, the stop target position becomes (45−40)/(45−35)*(90−88)+88=89 degrees. The upper swing structure is controlled to be stopped at the swing point of 89 degrees.

The swing motor position control unit 303 is installed between the stop target position calculation unit 302 and the swing motor, and if the stop target position is obtained as described above, the swing motor position control unit 303 controls the position of the swing motor so that the upper swing structure is stopped in the obtained stop target position. The detailed position control method is known, and the explanation thereof will be omitted.

Hereinafter, the operation of the swing control apparatus for a construction machine according to an embodiment of the present invention of FIG. 5 will be described with reference to FIG. 7.

Figure 7:
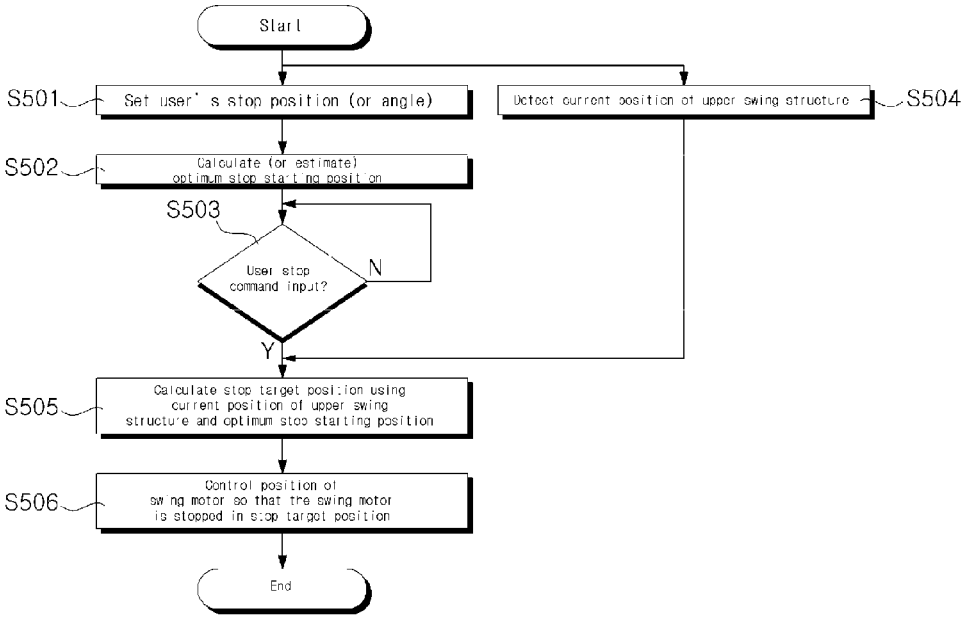
FIG. 7 is a flowchart illustrating a swing control method for a construction machine according to an embodiment of the present invention.

FIG. 7 is a flowchart illustrating the operation of the swing control apparatus for a construction machine (particularly, an excavator) according to an embodiment of the present invention.

As illustrated in FIG. 7, the stop position (or angle) of the upper swing structure is set according to the user's key operation (S501).

Then, the optimum stop starting position for stopping the upper swing structure in the stop position (or angle) set by the user is calculated or estimated through the start position estimation unit (S502).

For example, the optimum stop starting position may be calculated as follows.

In the case where the user optionally inputs the stop position (E2) with figures, the optimum stop starting position is typically calculated on the basis of a mass moment of inertia and a maximum torque of the upper swing structure of a general excavator or through preparation of a lookup table by experiments and interpolation using the lookup table.

For example, if a lookup table such as Table 2 is prepared, and E2 is set to 100 degrees, the optimum stop starting position (A2) becomes (135−100)/(135−80)*(80−45)+45=67.2 degrees.

TABLE 1

| | E2 | | | |
|---|---|---|---|---|
| | 45 | 90 | 135 | 180 |
| A2 | 25 | 45 | 80 | 135 |

Next, if the optimum stop starting position is calculated or estimated, the stop command of the upper swing structure is waited for.

Then, if the stop command for the upper swing structure is input according to the user's key operation (S503), the stop target position is calculated using the current position of the upper swing structure and the calculated or estimated optimum stop starting position through the stop target position calculation unit (S504 and S505).

For example, as illustrated in FIG. 6, if the current position is between A1 and A2, the stop target position is calculated through linear interpolation as below.

$$\text{stop target position}=(A2-\text{current position})/(A2-A1)*(E2-E1)+E1$$

Here, A2 denotes the optimum stop starting position, A1 denotes the minimum value that is set by the user based on A2 or in consideration of a preset stop command range, E2 denotes the stop position (or angle) set by the user, and E1 denotes the minimum position that is set by the user based on E2 or in consideration of a preset stop position range.

Then, as illustrated in FIG. 6, if the current position is between A2 and A3, the stop target position is calculated through linear interpolation as below.

$$\text{stop target position}=(A3-\text{current position})/(A3-A2)*(E3-E2)+E2$$

Here, A3 denotes the maximum value that is set by the user based on A2 or in consideration of a preset stop command range, E3 denotes the maximum position that is set by the user based on E2 or in consideration of a preset stop position range, and A2 and E2 denote the same as described above.

Lastly, if the stop target position is obtained, the position of the swing motor is controlled through the swing motor position control unit so that the upper swing structure is stopped in the obtained stop target position (S506).

As described above, according to the present invention, the optimum stop starting position for stopping the upper swing structure in the stop position (or at the stop angle) set by the user using the set stop position (or the set stop angle) is calculated or estimated, the stop target position is calculated using the current position of the upper swing structure and the calculated or estimated optimum stop starting position when the user's stop command is input, and the position of a swing motor is controlled so that the upper swing structure is stopped in the calculated stop target position. Accordingly, the upper swing structure can be stopped within the range that is determined by the predetermined equation even if the operator releases the lever or gives the stop command at different time points.

Figure 8:
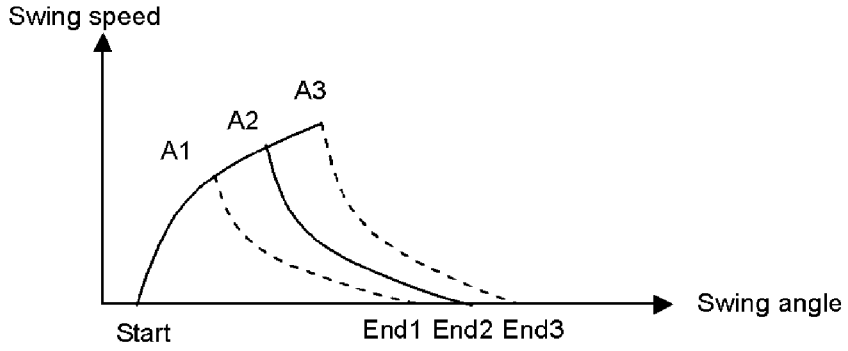
FIG. 8 is a diagram schematically illustrating a swing control operation according to an embodiment of the present invention.

That is, as illustrated in FIG. 8, the upper swing structure can be stopped within a predetermined narrowed range even if the operator releases the lever or gives the stop command at different time points (in the drawing, A1, A2, and A3), and thus the inconvenience can be solved which is caused by an additional driving operation that is required as the stop position differs depending on the time point where the stop command starts.

ADVANTAGEOUS EFFECT

The present invention can be used in the swing control apparatus for a construction machine, particularly, an excavator. The optimum stop starting position for stopping the upper swing structure in the stop position (or at the stop angle) set by the user using the set stop position (or the set stop angle) is calculated or estimated, the stop target position is calculated using the current position of the upper swing structure and the calculated or estimated optimum stop starting position when the user's stop command is input, and the position of a swing motor is controlled so that the upper swing structure is stopped in the calculated stop target position. Accordingly, the present invention can be used in the swing control apparatus for an excavator which can stop the upper swing structure within the determined range even if the operator releases the lever or gives the stop command at different time points.

The invention claimed is:

1. A swing control apparatus for a construction machine comprising:

a start position estimation unit calculating or estimating an optimum stop starting position for stopping an upper swing structure in a stop position (or at a stop angle) set by a user using the set stop position (or the set stop angle);

a stop target position calculation unit calculating a stop target position using a current position of the upper swing structure and the calculated or estimated optimum stop starting position when a user's stop command is input; and a swing motor position control unit controlling a position of a swing motor so that the upper swing structure is stopped in the calculated stop target position;

wherein the start position estimation unit is any one of a means for calculating the optimum stop starting position based on a mass moment of inertia and a maximum torque of the upper swing structure of the construction machine and a means for calculating the optimum stop starting position through interpolation using a lookup table that defines a mapping relation between the stop position set by the user and the stop starting position; and wherein the stop target position calculation unit is a means for calculating the stop target position that is determined as follows:

1) in the case where the current position is between A1 and A2, $$\text{stop target position}=[(A2-\text{current position})/(A2-A1)*(E2-E1)]+E1,$$

where A2 denotes the optimum stop starting position, A1 denotes the minimum value that is set by the user based on A2 or in consideration of a preset stop command range, E2 denotes the stop position (or angle) set by the user, and E1 denotes the minimum position that is set by the user based on E2 or in consideration of a preset stop position range, and 2) in the case where the current position is between A2 and A3, $$\text{stop target position}=[(A3-\text{current position})/(A3-A2)*(E3-E2)]+E2,$$

where A3 denotes the maximum value that is set by the user based on A2 or in consideration of a preset stop command range, E3 denotes the maximum position that is set by the user based on E2 or in consideration of a preset stop position range, A2 denotes the optimum stop starting position, and E2 denotes the stop position (or angle) set by the user.

2. A swing control method for a construction machine comprising:

calculating or estimating an optimum stop starting position for stopping an upper swing structure in a stop position (or at a stop angle) set by a user using the set stop position (or the set stop angle);

calculating a stop target position using a current position of the upper swing structure and the calculated or estimated optimum stop starting position when a user's stop command is input; and controlling the position of a swing motor so that the upper swing structure is stopped in the calculated stop target position;

wherein the step of calculating or estimating the stop starting position calculates the optimum stop starting position based on a mass moment of inertia and a maximum torque of the upper swing structure of the construction machine, or calculates the optimum stop starting position through interpolation through a lookup table that defines a mapping relation between the stop position set by the user and the stop starting position;

wherein the step of calculating the stop target position calculates the stop target position that is determined as follows:

1) in the case where the current position is between A1 and A2, $$\text{stop target position}=[(A2-\text{current position})/(A2-A1)*(E2-E1)]+E1,$$

where A2 denotes the optimum stop starting position, A1 denotes the minimum value that is set by the user based on A2 or in consideration of a preset stop command range, E2 denotes the stop position (or angle) set by the user, and E1 denotes the minimum position that is set by the user based on E2 or in consideration of a preset stop position range, and 2) in the case where the current position is between A2 and A3, $$\text{stop target position}=[(A3-\text{current position})/(A3-A2)*(E3-E2)]+E2,$$

where A3 denotes the maximum value that is set by the user based on A2 or in consideration of a preset stop command range, E3 denotes the maximum position that is set by the user based on E2 or in consideration of a preset stop position range, A2 denotes the optimum stop starting position, and E2 denotes the stop position (or angle) set by the user.

* * * * *